US010823183B2

(12) United States Patent
Svarre et al.

(10) Patent No.: US 10,823,183 B2
(45) Date of Patent: Nov. 3, 2020

(54) CENTRIFUGAL PUMP

(71) Applicant: GRUNDFOS HOLDING A/S, Bjerringbro (DK)

(72) Inventors: Erik Bundesen Svarre, Bjerringbro (DK); Jan Carøe Aarestrup, Bjerringbro (DK); Peter Elvekjær, Trustrup (DK); Flemming Munk, Viborg (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 612 days.

(21) Appl. No.: 15/384,603

(22) Filed: Dec. 20, 2016

(65) Prior Publication Data

US 2017/0175749 A1 Jun. 22, 2017

(30) Foreign Application Priority Data

Dec. 21, 2015 (EP) ..... 15201513

(51) Int. Cl.
*F04D 27/00* (2006.01)
*F04D 13/06* (2006.01)
(Continued)

(52) U.S. Cl.
CPC ..... *F04D 27/001* (2013.01); *F01D 5/02* (2013.01); *F04D 1/06* (2013.01); *F04D 13/06* (2013.01);
(Continued)

(58) Field of Classification Search
CPC ..... F04D 27/001; F04D 17/08; F04D 17/122; F04D 17/12; F04D 13/06; F01D 5/02; G01F 1/12
See application file for complete search history.

(56) References Cited

U.S. PATENT DOCUMENTS 2,602,330 A * 7/1952 Kollsman ..... G01F 1/82 73/861.353
3,021,788 A * 2/1962 Kaatz ..... F04D 15/0218 417/18

(Continued)

FOREIGN PATENT DOCUMENTS

EP 2 072 829 A1 6/2009

OTHER PUBLICATIONS

MDPI and ACS Style Simão, M.; Pérez-Sánchez, M.; Carravetta, A.; López-Jiménez, P.; Ramos, H.M. Velocities in a Centrifugal PAT Operation: Experiments and CFD Analyses. Fluids 2018, 3, 3. (Year: 2017).*

(Continued)

*Primary Examiner* — Kenneth Bomberg
*Assistant Examiner* — Hakeem M Abdellaoui
(74) *Attorney, Agent, or Firm* — McGlew and Tuttle, P.C.

(57) ABSTRACT

A centrifugal pump includes at least one pump stage (14). This pump stage (14) includes an impeller (18) which is mounted rotationally fixed on a pump shaft (26). Apart from the pump stage (14), the centrifugal pump is equipped with a turbine wheel (32) which is arranged on the pump shaft (26), without a movement coupling to the pump shaft, in the delivery flow of the centrifugal pump. This turbine wheel (32) forms a transducer of a flow measuring device. A blading of the turbine wheel (32) is such that a torque exerted by the delivery flow onto the turbine wheel (32') is directed counter to a torque exerted via the pump shaft (26) onto the impeller (18).

20 Claims, 3 Drawing Sheets

(51) Int. Cl.

| | |
|---|---|
| ***F01D 5/02*** | (2006.01) |
| ***F04D 1/06*** | (2006.01) |
| ***F04D 15/00*** | (2006.01) |
| ***F04D 17/08*** | (2006.01) |
| ***F04D 29/043*** | (2006.01) |
| ***F04D 29/053*** | (2006.01) |
| ***F04D 29/22*** | (2006.01) |
| ***F04D 29/28*** | (2006.01) |

(52) U.S. Cl.
CPC ..... *F04D 15/0088* (2013.01); *F04D 17/08* (2013.01); *F04D 29/043* (2013.01); *F04D 29/053* (2013.01); *F04D 29/22* (2013.01); *F04D 29/28* (2013.01)

(56) References Cited

U.S. PATENT DOCUMENTS 3,232,110 A * 2/1966 Li ..... G01F 1/82 73/861.353
4,439,728 A * 3/1984 Rickman, Jr. ..... G01P 5/07 324/164
6,811,382 B2 * 11/2004 Buchanan ..... E21B 43/128 415/199.1
7,170,284 B2 * 1/2007 Roeseler ..... F01D 17/06 324/207.25
2014/0199155 A1 * 7/2014 Malone ..... F01D 15/02 415/1
2014/0219841 A1 * 8/2014 Kozaki ..... F04D 19/042 417/423.12
2014/0366632 A1 * 12/2014 Lerchenmueller ..... F01D 17/06 73/509
2016/0084069 A1 * 3/2016 Camacho Cardenas ..... F04D 13/10 415/118
2017/0268524 A1 * 9/2017 Kanai ..... H02P 29/00

OTHER PUBLICATIONS (n.d.). Retrieved from https://ipfs.io/ipfs/QmXoypizjW3WknFiJnKLwHCnL72vedxjQkDDP1mXWo6uco/wiki/Euler_equations_(fluid_dynamics).html (Year: 2016).*

* cited by examiner

CENTRIFUGAL PUMP

CROSS REFERENCE TO RELATED APPLICATIONS

This application claims the benefit of priority under 35 U.S.C. § 119 of European Application 15 201 513.7 filed Dec. 21, 2015, the entire contents of which are incorporated herein by reference.

FIELD OF THE INVENTION

The present invention relates to a centrifugal pump.

BACKGROUND OF THE INVENTION

Centrifugal pumps as a rule are driven by electrical drive motors. The activation of these drive motors and thus, entailed by this, the activation of the centrifugal pump is improved with an increasing knowledge of the operating condition of the centrifugal pump which changes during operation as the case may be. Inasmuch as this is concerned, it is useful to continuously detect certain condition parameters with regard to the centrifugal pump during its operation, in order to permits these to be included in the activation of the drive motor. The delivery flow through the centrifugal pump is also counted as belonging to these condition parameters.

SUMMARY OF THE INVENTION

Against this background, an object of the invention lies in creating a centrifugal pump, with which the delivery flow through the centrifugal pump can be detected with a high accuracy, with a comparatively inexpensive construction.

This object is achieved by a centrifugal pump comprising a pump shaft, at least one pump stage with an impeller mounted rotationally fixed on the pump shaft and a turbine wheel arranged on the pump shaft, without a movement coupling of the turbine wheel to the pump shaft with a delivery flow of the centrifugal pump. The turbine wheel forms a transducer of a flow measuring device. The turbine wheel comprises turbine wheel blading configured such that a torque exerted by the delivery flow onto the turbine wheel is directed counter to a torque exerted via the pump shaft onto the impeller.

With regard to the centrifugal pump according to the invention, it is preferably the case of a multistage pump. That means that the centrifugal pump preferably comprises more than one pump stage which is provided with an impeller mounted on a pump shaft in a rotationally fixed manner. The pump stage in the usual manner also has at least one diffuser, in order to provide an as swirl-free as possible flow at the exit side of the pump stage. The centrifugal pump is preferably designed as a multi-stage centrifugal pump, with which several pump stages which are flow-connected to one another, in each case with an impeller and a diffuser, are provided successively in the direction of the pump shaft.

Apart from the pump stage or the pump stages, the centrifugal pump comprises a turbine wheel. This turbine wheel is arranged on the pump shaft without a movement coupling to the pump shaft, namely the turbine wheel is connected to the pump shaft without being rotationally coupled with the pump shaft. Hereby, the pump shaft engages through a hub which is formed centrically on the turbine wheel, wherein the pump shaft can rotate relative to the surrounding turbine wheel and/or vice versa. The turbine wheel forms a transducer of a flow measuring device, with which the delivery flow through the centrifugal pump or the flow speed of the fluid delivered by the centrifugal pump is detected within the centrifugal pump. For this, the turbine wheel basically has a design, with which the delivery flow exerts a torque upon the turbine wheel about its middle axis. As a transducer, the turbine wheel is responsive to the torque exerted on the turbine wheel. Based on the response, the flow measuring device generates a measurement signal which is proportional to the delivery flow and which is received by a signal receiver of the flow measuring device and can subsequently e.g. be included in the activation of a drive motor for the drive of the centrifugal pump. The flow measuring device includes a means for sensing the response of the turbine wheel to the torque exerted by the delivery flow and generating a measurement signal. With regard to the measurement signal which is produced, based on the response of the turbine wheel, it can be the case of the torque which is exerted by the delivery flow upon the turbine wheel is the response for which a measurement signal is generated or a speed of a rotation movement of the turbine wheel which is caused by the torque is the response for which a measurement signal is generated, and this will be dealt with hereinafter in more detail in connection with preferred further developments of centrifugal pump according to the invention.

Although the turbine wheel with regard to the design is not coupled in movement to the pump shaft, the bearing friction of a radial bearing which as the case may be is arranged between the pump shaft and the turbine wheel, and/or solid matter which has gotten into an intermediate space between the pump shaft and the turbine wheel, can create a friction fit between the pump shaft and the turbine wheel. Such a friction connection causes considerable inaccuracies in measurement, when measuring the flow, since it leads to the torque which actually acts upon the turbine wheel differing from the torque which is exerted upon the turbine wheel by the delivery flow and which directly or indirectly forms the basis for determining the delivery flow, in particular at lower speeds of the pump shaft, and, entailed by this, at a lower delivery power of the centrifugal pump.

What is essential with regard to the invention is that the torque which is exerted upon the turbine wheel by the delivery flow is directed counter to a torque which is exerted via the pump shaft onto the impeller of the at least one pump stage, in order to counteract these measurement inaccuracies with the flow measurement. This means that when the pump shaft and the impeller of the at least one pump stage which is fixedly connected to the shaft are driven in a clockwise manner in the flow direction of the centrifugal pump, the blading of the turbine wheel is such that the turbine wheel is subjected to force in an anti-clockwise manner by the delivery flow through the centrifugal pump. In the reverse case, when the pump shaft and the impeller of the at least one pump stage are driven in an anti-clockwise manner in the flow direction of the centrifugal pump, the blading of the turbine wheel is typically designed such that the turbine wheel is subjected to force in a clockwise manner by the delivery flow through the centrifugal pump. It has been found that with this design, the torque which is exerted onto the turbine wheel by the delivery flow forms a variable which to the greatest possible extent is proportional to the delivery flow, even with a comparatively low delivery power, so that the delivery flow can be determined with sufficient accuracy.

According to a first preferred further development of the centrifugal pump according to the invention, the turbine wheel is arranged downstream of a last pump stage of the centrifugal pump. Accordingly, with a centrifugal pump with only one pump stage, the turbine wheel is arranged downstream of the pump stage in the flow direction of this pump stage, and with a multi-stage centrifugal pump, in the flow direction of the pump stages, is arranged downstream of the pump stage which is distanced furthest from the fluid inlet of the pump. This measure is also directed to increasing the measuring accuracy with the flow measurement, since the turbine wheel in this manner is distanced as far as possible from flow changes or pressure changes which occur in the region of the fluid inlet of the centrifugal pump as the case may be. Otherwise, the pressure chamber downstream of the last pump stage as a rule provides sufficient space for the arrangement of the turbine wheel, so that the arrangement of the turbine wheel has no effect on the total size of the centrifugal pump.

As has already been noted, a speed of a rotation movement of the turbine wheel, said rotation movement caused by the delivery flow through the centrifugal pump, can be used as the measurement signal produced by the turbine wheel. This permits a further advantageous design of the centrifugal pump according to the invention, with which the turbine wheel is rotatably mounted on the pump shaft. The turbine wheel is thus preferably rotatable relative to the pump shaft by the delivery flow through the centrifugal pump, and specifically in the rotation direction which is opposite to the rotation direction of the pump shaft.

In combination with this design, usefully at least one signal means which moves relative to a signal receiver of a sensor of the flow measuring device is arranged on the turbine wheel. Concerning an as large as possible measurement value resolution, it has hereby been found to be advantageous if the at least one signal means is arranged on a largest outer periphery of the turbine wheel. With a turbine wheel, this largest outer periphery as a rule is formed by an outer ring which surrounds the blades of the turbine wheel at the outer periphery, and accordingly it is particularly favorable to arrange the at least one signal means on the outer periphery of this outer ring.

In a further development of this design, one preferably envisages at least three signal means being arranged on the outer periphery of the turbine wheel, wherein these have a different distance to one another in the rotation direction of the turbine wheel. The at least three signal means which are distanced to one another by a different amount in the rotation direction of the turbine wheel, in combination with a suitable evaluation device, apart from the rotation speed also permit the rotation direction of the turbine wheel to be determined. Although this rotation direction of the turbine wheel should be directed counter to the rotation direction of the pump shaft in the normal case, however under certain circumstances, for example due to the penetration of solid matter particles into the intermediate space between the hub of the turbine wheel and the pump shaft, it can also correspond to the rotation direction of the pump shaft on account of the jamming of the turbine wheel with the pump shaft which is caused by way of this. Apart from that, the rotation direction of the turbine wheel always corresponds to the rotation direction of the pump shaft because of friction between the turbine wheel and the pump shaft in case the flow rate of the pump lies below a certain value. The flow measuring device is not capable of functioning in this case. Such a non-functionability of the flow measuring device however can be directly recognized and be subsequently overcome due to the possibility of determining a wrong rotation direction of the turbine wheel in accordance with the invention.

With a turbine wheel which is rotatably mounted relative to the pump shaft, the rotation speed and the rotation direction of the turbine wheel can generally be determined by all sensor arrangements which are known for determining the speed of a moved body relative to a stationary body. However, a magnetic-inductive speed measurement is preferably envisaged. Inasmuch as this is concerned, a design, with which the at least one signal means is a permanent magnet, and the signal receiver of the sensor is a magnetic flux sensor, is preferred. Accordingly, at least one permanent magnetic is usefully arranged in an embedded manner on an outer periphery of the turbine wheel and advantageously on the outer ring surrounding the blades of the turbine wheel, and on rotation of the turbine wheel is moved relative to a magnetic flux sensor which is arranged in a stationary manner in the centrifugal pump, wherein the magnetic flux sensor of the sensor detects a magnetic field changing due to the rotation of the turbine wheel and converts it into an electrical signal which is led to a control device which is signal-connected to the sensor, for determining the rotation speed of the turbine wheel and the delivery flow through the centrifugal pump.

Instead of a magnetic-inductive measurement of the rotation speed of the turbine wheel, this can also be optically detected. Thus, as an alternative to at least one permanent magnet arranged on the turbine wheel and to a magnetic flux sensor arranged in the centrifugal pump in a stationary manner, e.g. a design with which the at least one signal means is a light reflector which moves through the beam path of a light source on rotation of the turbine wheel can also be advantageous, wherein the sensor comprises a light sensor which is arranged in the reflection beam path of the reflector. With this design, the light sensor receives a light signal with each passage of the at least one light reflector through the beam path of a light beam emitted by the light source arranged is a stationary manner relative to the turbine wheel, wherein a control device which is signal-connected to the sensor determines the rotation speed of the turbine wheel and, entailed by this, the delivery flow through the centrifugal pump, from this light signal.

The turbine wheel can also be advantageously arranged in the centrifugal pump in a rotationally fixed manner as an alternative to an arrangement of this turbine wheel which is rotatable relative to the pump shaft, wherein the pump shaft can rotate in the inside of the turbine wheel. In this case, the subjection of the turbine wheel to onflow by the delivery flow, although not effecting a rotation movement of the turbine wheel, however the torque acting upon the turbine wheel can be detected and thus directly form the basis for determining the delivery flow or the flow speed of the fluid flowing through the centrifugal pump.

In an advantageous further development of this design, the flow measuring device comprises a sensor in the form of a force sensor which is arranged in a manner such that it measures a torque action upon the turbine wheel. Here too, the sensor is usefully arranged in or on the centrifugal pump in a stationary manner, wherein it is actively connected to the turbine wheel. Basically, all sensors which are suitable for detecting forces or moments, such as for example strain gauges, piezoelectric sensors and likewise, can be used as force sensors.

The force sensor is preferably not in direct contact with the turbine wheel, but is actively connected to the turbine wheel via a component which is suitable for transmitting forces or moments, which renders it possible to arrange the force sensor at a particularly favourable location in the centrifugal pump. One advantageously envisages at least one recesses being formed on the outer periphery of the turbine wheel, into which recess a movement arm in contact with the force sensor engages. The moment arm is hereby formed by a component which is designed in a torsionally rigid manner and via which a torque acting upon the turbine wheel can be transmitted onto the force sensor arranged distanced to the turbine wheel, in an unadulterated manner. For this, the moment arm with a free end is usefully in contact with the force sensor and with another end engages into the at least one recess on the turbine wheel with a positive fit.

On assembly of the centrifugal pump, the turbine wheel is aligned in a manner such that the moment arm positively engages into the recess formed on the turbine wheel, for fixing the moment arm on the turbine wheel. This work is simplified by way of a multitude of recesses for receiving the moment arm being formed over the outer periphery of the turbine wheel, as is further preferably envisaged, so that the moment arm can positively engage into any of the recesses formed on the outer periphery of the turbine wheel, for fixation on the turbine wheel.

According to a further preferred development of the invention, the sensor of the flow measuring device is arranged outside the interior of the pump casing of the centrifugal pump. This design, with which the sensor does not engage into the inside of the pump casing, but however can indeed be integrated in a wall part of the pump casing, is advantageous inasmuch as electrical components of the sensor are protected from the delivery flow in the inside of the pump casing in this manner, without these components for this having to be encapsulated in a fluid tight manner with respect to the delivery flow through the centrifugal pump, which is quite cumbersome.

Preferably, an opening, at the outer side of which the sensor is arranged, is formed on the outer wall of the pump casing. This arrangement of the sensor has the advantage that the sensor is not only protected from the delivery flow in the pump casing to a sufficient extent, but is also well accessible, for example for maintenance or repair purposes. Furthermore, the opening, on which the sensor is usefully arranged in a removable manner without destruction, can also be used for bleeding the pump casing on removal of the sensor, so that no additional opening needs to be formed on the pump casing for this purpose.

The invention is hereinafter explained in more detail by way of embodiment examples represented in the drawings. In each case in a schematically simplified manner and in different scales. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 2:
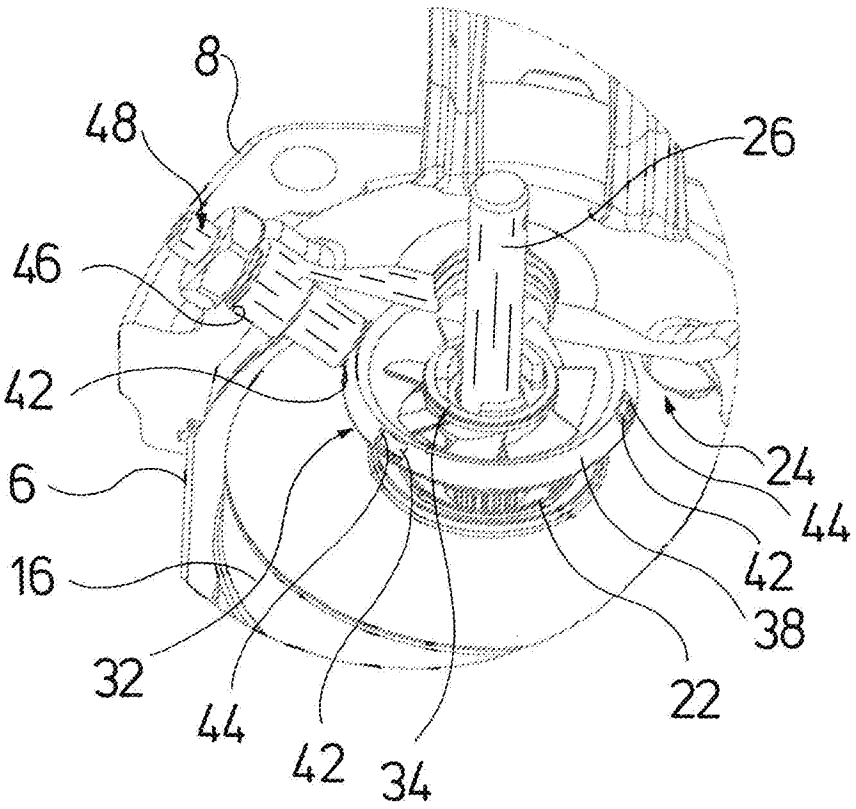
FIG. 2 is a detail A of FIG. 1.
Figure 1:
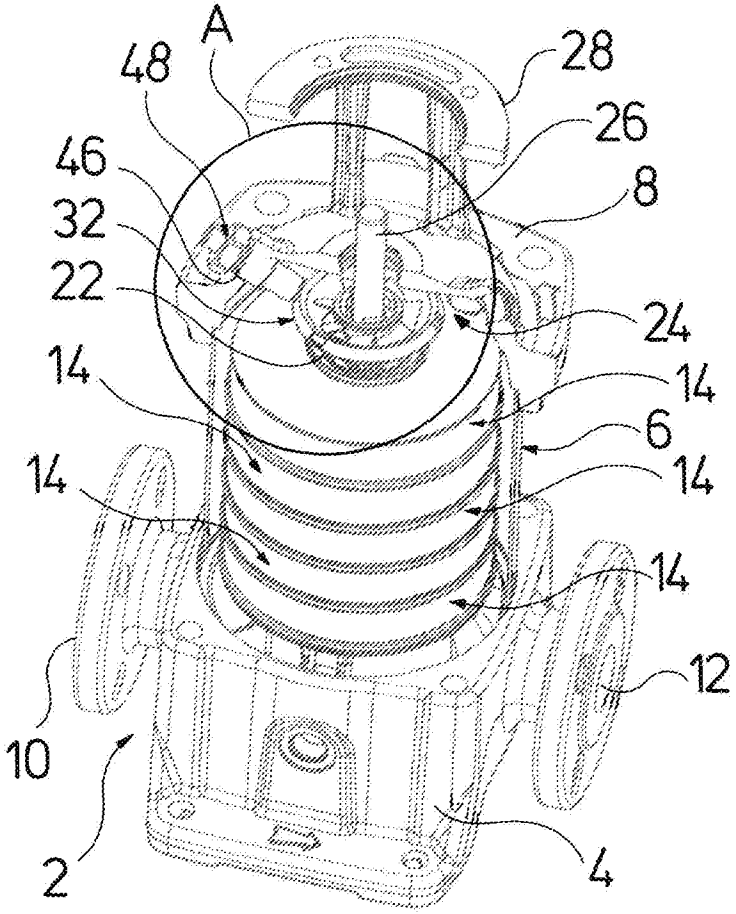
FIG. 1 is a partly sectioned perspective representation of a centrifugal pump according to a first design.
Figure 5:
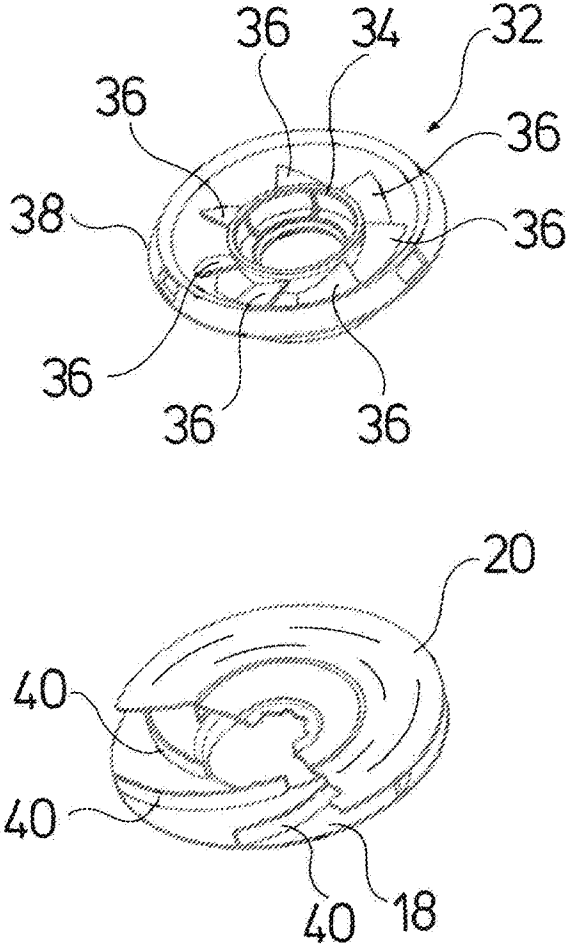
FIG. 5 is a perspective, comparison view showing a turbine wheel as well as an impeller and diffuser of a pump stage of the centrifugal pumps according to FIGS. 1 and 3.

Referring to the drawings, the centrifugal pump which is represented in FIGS. 1 and 2 comprises a pump casing 2 which is formed by a casing lower part 4, by a hollow-cylindrical casing middle part 6 which connects thereto and by a subsequent casing upper part 8. A fluid inlet 10 and a fluid outlet 12 of the centrifugal pump are formed on the casing lower part 4. The fluid inlet 10 is flow-connected to five pump stages 14 of the centrifugal pump which are arranged in the region of the casing middle part 6 over one another in the direction of the casing upper part 8. Each of the pump stages 14 comprises a housing 16 which is arranged in the pump casing in a stationary manner and in which an impeller 18 and a diffuser which is to say guide wheel 20 are arranged, these being represented in FIG. 5. The housings 16 are each flow-connected to adjacent housings 16, wherein a housing 16 which is last in the direction of the casing upper part 8 is flow-connected via an opening 22 to a pressure chamber 24 which is formed in the region of the casing upper part 8.

The impellers 18 of the pump stages 14 are connected to a pump shaft 26 in a rotationally fixed manner, said pump shaft extending concentrically to the casing middle part 6 through the pump casing 2 and projecting out of the pump casing 2 at the casing upper part 8. There, the pump shaft 26 is connected to the motor shaft of a drive motor which is not represented and which is mounted on a motor stool 28 which is formed on the casing upper part 8. When the pump shaft 26 is driven, the impellers 18 of the individual pump stages deliver a fluid from the fluid inlet 10 through the pump stages 14 to the pressure chamber 24, from where the fluid goes via an annular gap 30 between the wall of the casing middle part 6 and the housing 16 of the pump stages, to the fluid outlet 12 of the centrifugal pump. Alternatively, the fluid outlet 12 could also be situated at the opposite axial end of the centrifugal pump.

A turbine wheel 32 is rotatably mounted in the pressure chamber 24, downstream of the pump stage 14 which is last in the flow direction and which is directly adjacent the pressure chamber 24. This turbine wheel 32 is arranged around the pump shaft 26, wherein the pump shaft 26 engages through a hub 34 of the turbine wheel 32 and the turbine wheel 32 is rotatably mounted on the pump shaft 26. Several blades 36, departing from the hub 34, extend outwards in the radial direction, where they are connected to an outer ring 38 of the turbine wheel 32. Hereby, the blades 36 of the turbine wheel 32 in the flow direction of the centrifugal pump are arranged directly above the opening 22 which is formed on the last pump stage 14 and via which the delivery flow in the axial direction of the pump housing goes through the centrifugal pump into the pressure chamber 24. The delivery flow exerts a torque upon the turbine wheel 32 by way of it hitting the blades 36 of the turbine wheel 32, by which means this is brought into a rotation movement. The torque which is exerted by the delivery flow onto the turbine wheel is hereby directed counter to the torque which is exerted upon the impeller 18 via the pump shaft 26 for the purpose of fluid delivery, which is also made clear by way of the turbine wheel 32 and the impeller 18 which are each represented in the installed condition in FIG. 5, since there it can be recognized that the blades 36 of the turbine wheel 32 are aligned quasi counter to the blades 40 of the turbine wheel 18. Thus, the turbine wheel 32 rotates oppositely to the pump shaft 26 on operation.

The turbine wheel 32 forms a transducer of a flow measuring device, with which the delivery flow through the centrifugal pump is continuously determined during the operation of the centrifugal pump, in order e.g. subsequently to be included in the activation of the drive motor for the centrifugal pump. The turbine wheel 32 which is represented in FIGS. 1 and 2, for forming a transducer is provided with three signal means in the form of permanent magnets 42 which are arranged in three recesses 44 formed on the outer peripheral side of the outer ring 38 of the turbine wheel 32 at distances which are different from one another with respect to the rotation direction of the turbine wheel 32.

An opening 46 is formed on the casing upper part 8 of the pump casing 2. A sensor 48 of the flow measuring device which extends up to the direct vicinity of the outer ring 38 of the turbine wheel 32 engages through this opening 46. This sensor 48 comprises a signal receiver in the form of a magnetic flux sensor which on rotation of the turbine wheel 32 detects the magnetic fields which come from the three permanent magnets 42, whereupon a control device which is signal-connected to the sensor 48 and which is not represented in the drawings, determines the rotation speed of the turbine wheel 32 and this, entailed by this, the delivery flow through the centrifugal pump. The control device can hereby also determine the rotation direction of the turbine wheel 32 due to the different distance of the permanent magnets 42 to one another.

Figure 6:
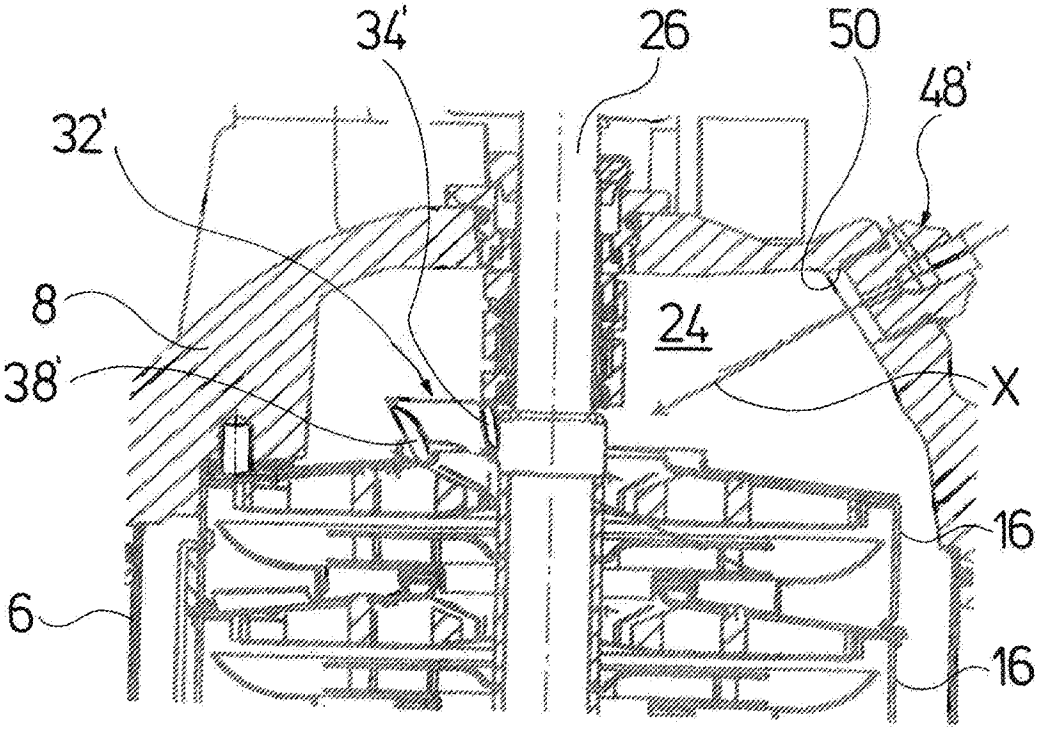
FIG. 6 is a sectioned view showing a part of a centrifugal pump according to a third design.

The centrifugal pump which is only partly represented in FIG. 6 differs from the centrifugal pump represented in FIGS. 1 and 2 only with regard to the design of the flow measuring device. Here too, the transducer of the flow measuring device is formed by a turbine wheel 32' which is rotatably mounted on the pump shaft 26, wherein the pump shaft 26 engages through a hub 34' of the turbine wheel 32'. The type and arrangement of the blades 36 of the turbine wheel 32' correspond to that of the turbine wheel 32 of the centrifugal pump represented in FIGS. 1 and 2.

An opening 50 which is provided with a thread and into which a sensor 48' of the flow measuring device is screwed is formed on the casing upper part 8 of the pump casing 2, obliquely above the turbine wheel 32', wherein the sensor 48' although engaging partly into the opening 50, however does not project into the inside of the pressure chamber 24. On removing the sensor 48', the opening 50 can be used for used for bleeding the pump casing.

Although not directly evident from FIG. 6, the sensor 48' has a light source and a light sensor, which are arranged essentially at the outer side of the casing upper part 8 or outside the pump casing 2. A light beam X which is emitted from the light source of the sensor 48' is incident on the outer ring 38' of the turbine wheel 32'.

In contrast to the turbine wheel 32 of the centrifugal pump according to FIGS. 1 and 2, several light reflectors which are not represented and which, given a rotation of the turbine wheel 32' caused by the delivery flow, move through the beam path of the light beam X, are arranged over the outer periphery of the outer ring 38' at different distances, on the outer ring 38' of the turbine wheel 32' instead of the sensors with the centrifugal pump represented in FIGS. 1 and 2. As soon as the light beam X is incident on one of the light reflectors, this beam is reflected back to the sensor 48' where it is detected by the light sensor which is arranged in the sensor 48'. A control device which has likewise been omitted from FIG. 6 for reasons of a better overview and which is signal-connected to the light sensor determines the rotation speed of the turbine wheel 32' from this and consequently the delivery flow through the centrifugal pump. Moreover, the rotation direction of the turbine wheel can also be determined by the control device on account of the different distance of the light reflectors to one another.

Figure 4:
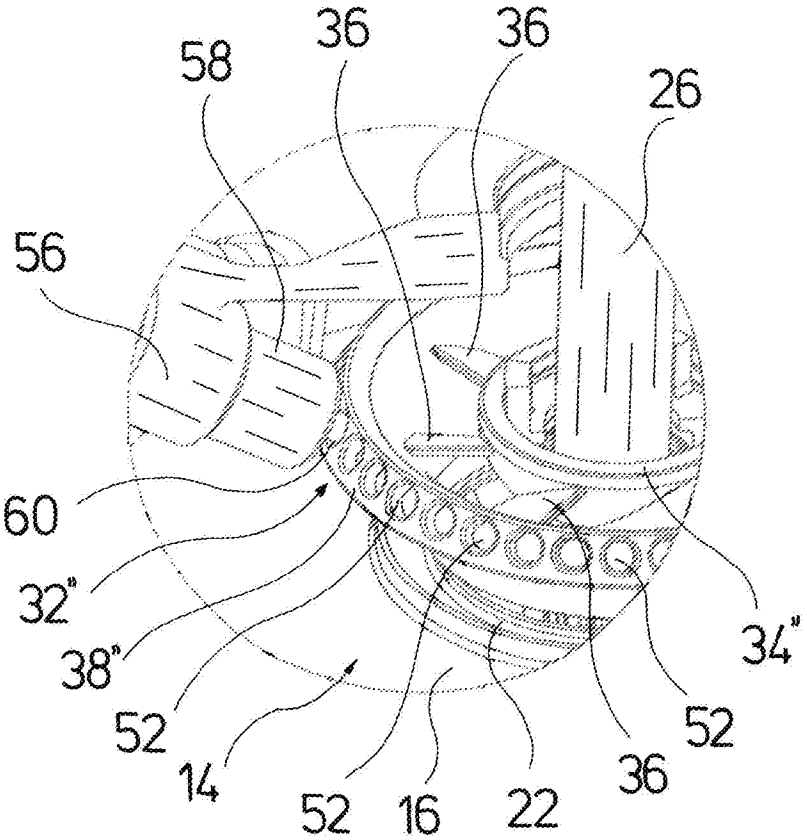
FIG. 4 is a detail B of FIG. 3.
Figure 3:
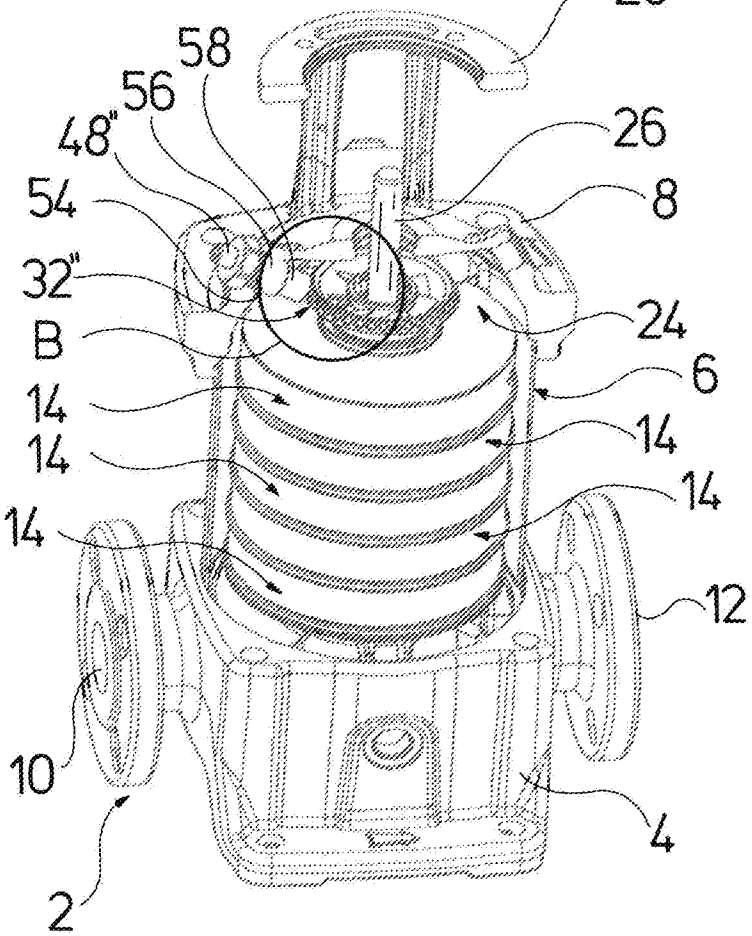
FIG. 3 is a partly sectioned perspective representation of a centrifugal pump according to a second design.

The centrifugal pump which is represented in FIGS. 3 and 4 also differs from the centrifugal pump represented in FIGS. 1 and 2 only with regard to the design of the flow measuring device. With this flow measuring device too, a transducer is formed by a turbine wheel 32". The arrangement of this turbine wheel 32" in the pressure chamber 24 is such that the pump shaft 26 engages through a hub 34" of the turbine wheel 32". The type and arrangement of the blades 36 of the turbine wheel 32" correspond to those of the turbine wheels 32 and 32'. A multitude of recesses 52, the significance of which are dealt with hereinafter, are formed on an outer ring 38" of the turbine wheel 32", uniformly distributed on its outer periphery.

An opening 54, whose middle axis is directed to the outer periphery of the outer ring 38" of the turbine wheel 32" is formed on the casing upper part 8 of the pump casing 2, obliquely above the turbine wheel 32". A sleeve 56 connects to the opening 54, in the pressure chamber 24. A moment arm 58 which engages into the inside of the pressure chamber 24 engages through this sleeve 56. In the sleeve 56, the moment arm 58 is positively fixed transversely to its longitudinal extension. The moment arm 58 at its end which engages into the inside of the pressure chamber 24 comprises a cylindrical projection 60, whose outer cross section corresponds to the cross section of the recesses 52 formed on the outer ring 38" of the turbine wheel 32". The moment arm 58 with the projection 60 engages into one of the recesses 52 on the outer ring 38" of the turbine wheel 32", by which means the turbine wheel 32 is prevented from rotationally moving.

Apart from the moment arm 58, a sensor 48" of the flow measuring device also engages into the sleeve 56. This sensor 48" has a signal receiver which is not evident from the drawing, in the form of a force sensor which is in contact with the moment arm 58. If the blades 36 of the turbine wheel 32" are subjected to onflow by the delivery flow through the centrifugal pump, the turbine wheel 32" although not being able to rotate, the delivery flow then however effects a torque or force action upon the turbine wheel 32", said torque or force action being led further from the turbine wheel 32" via the moment arm 58 to the sensor 48" and is detected there by the force receiver, whereupon the delivery flow through the centrifugal pump is determined by a control device which is signal-connected to the force sensor and which is likewise not shown in the drawing, on the basis of the detected moment or the detected force action.

While specific embodiments of the invention have been shown and described in detail to illustrate the application of the principles of the invention, it will be understood that the invention may be embodied otherwise without departing from such principles.

APPENDIX

List of Reference Symbols

| | |
|---|---|
| 2 | pump casing |
| 4 | casing lower part |
| 6 | casing middle part |
| 8 | casing upper part |
| 10 | fluid inlet |
| 12 | fluid outlet |
| 14 | pump stage |
| 16 | housing |
| 18 | impeller |
| 20 | diffuser |
| 22 | opening |
| 24 | pressure chamber |
| 26 | pump shaft |
| 28 | motor stool |
| 30 | annular gap |
| 32, 32', 32" | turbine wheel |
| 34, 34', 34" | hub |
| 36 | blade |
| 38, 38', 38" | outer ring |
| 40 | blade |
| 42 | permanent magnet |
| 44 | recess |
| 46 | opening |
| 48, 48', 48" | sensor |
| 50 | opening |
| 52 | recess |
| 54 | opening |
| 56 | sleeve |
| 58 | moment arm |
| 60 | projection |
| A | detail |
| B | detail |
| X | light beam |

What is claimed is:

1. A centrifugal pump comprising:

a pump shaft;

at least one pump stage with an impeller mounted rotationally fixed on the pump shaft;

a flow measuring device comprising a transducer, the transducer comprising a turbine wheel arranged on the pump shaft with the turbine wheel not being rotationally coupled with the pump shaft with a delivery flow of the centrifugal pump, wherein the turbine wheel is exposed to the delivery flow of the centrifugal pump and is responsive to a torque exerted by the delivery flow onto the turbine wheel, the turbine wheel comprising turbine wheel blading configured such that the torque exerted by the delivery flow onto the turbine wheel is directed counter to a torque exerted via the pump shaft onto the impeller.

2. The centrifugal pump according to claim 1, wherein the turbine wheel is arranged downstream of a last pump stage of said at least one pump stage.

3. The centrifugal pump according to claim 1, wherein the turbine wheel is rotatably mounted on the pump shaft for rotation about the pump shaft and relative to the pump shaft.

4. The centrifugal pump according to claim 3, wherein:

the turbine wheel rotates in response to the torque exerted by the delivery flow onto the turbine wheel; and the flow measuring device further comprises at least one signal means and a sensor comprising a signal receiver wherein the at least one signal means is arranged on the turbine wheel, which moves with the turbine wheel relative to the signal receiver.

5. The centrifugal pump according to claim 4, the flow measuring device further comprises additional signal means wherein at least three of the signal means are arranged on an outer periphery on the turbine wheel and have spaced apart from one another in a rotation direction of the turbine wheel.

6. The centrifugal pump according to claim 4, wherein the at least one signal means is a permanent magnet, and the signal receiver of the sensor is a magnetic flux sensor.

7. The centrifugal pump according to claim 5, wherein the at least one signal means is a permanent magnet, and the signal receiver of the sensor is a magnetic flux sensor.

8. The centrifugal pump according to claim 4, wherein:

the flow measuring device further comprises a light source;

the at least one signal means is a light reflector which, upon rotation of the turbine wheel, moves through a beam path of the light source; and the sensor comprises a light sensor which is arranged in the reflection beam path of the reflector.

9. The centrifugal pump according to claim 5, wherein:

the flow measuring device further comprises a light source;

the at least one signal means is a light reflector which, upon rotation of the turbine wheel, moves through a beam path of the light source; and the sensor comprises a light sensor which is arranged in the reflection beam path of the reflector.

10. The centrifugal pump according to claim 1, wherein the turbine wheel is arranged in the centrifugal pump in a rotationally fixed manner.

11. A centrifugal pump according to claim 10, wherein the flow measuring device further comprises a force sensor which measures a torque that is responsive to the torque exerted by the delivery flow and acting upon the turbine wheel.

12. The centrifugal pump according to claim 11, wherein at least one recess is formed on an outer periphery of the turbine wheel, into which recess a moment arm in contact with the force sensor engages.

13. The centrifugal pump according to claim 12, wherein a plurality of recesses for receiving the moment arm are formed over the outer periphery of the turbine wheel.

14. The centrifugal pump according to claim 2, wherein the turbine wheel is arranged in the centrifugal pump in a rotationally fixed manner.

15. The centrifugal pump according to claim 1, further comprising a pump casing, wherein the flow measuring device comprises a sensor, which is arranged outside an inner space of the pump casing of the centrifugal pump.

16. The centrifugal pump according to claim 12, further comprising a pump casing, wherein the flow measuring device comprises a sensor and an opening is formed on an outer wall of the pump casing, at an outer side of which opening the sensor is arranged.

17. A centrifugal pump comprising:

a pump shaft;

at least one pump stage with an impeller mounted on the pump shaft and fixed to the pump shaft for rotation with the pump shaft;

a flow measuring device for continuously measuring a delivery flow through the centrifugal pump during operation of the centrifugal pump, the flow measuring device comprising:

a transducer comprising a turbine wheel connected to the pump shaft and not rotationally coupled with the pump shaft, the turbine wheel being exposed to the delivery flow through the centrifugal pump and being responsive to a torque exerted by the delivery flow onto the turbine wheel, the turbine wheel comprising turbine wheel blading configured such that the torque exerted by the delivery flow onto the turbine wheel is directed counter to a torque exerted via the pump shaft onto the impeller; and means for sensing the response of the turbine wheel to the torque exerted by the delivery flow onto the turbine wheel and generating a measurement signal based on the sensed response.

18. The centrifugal pump according to claim 17, wherein:

the turbine wheel is mounted to rotate in response to the torque exerted by the delivery flow onto the turbine wheel;

the means for sensing the response of the turbine wheel to the torque exerted by the delivery flow comprises:

a signal indicator fixed to the turbine wheel, the signal indicator comprising a permanent magnet; and a signal receiver comprising a magnetic flux sensor.

19. The centrifugal pump according to claim 17, wherein:

the turbine wheel is mounted to rotate in response to the torque exerted by the delivery flow onto the turbine wheel; and the means for sensing the response of the turbine wheel to the torque exerted by the delivery flow comprises:

a light source;

a light reflector fixed to the turbine wheel, the light reflector moving through a beam path of the light source upon rotation of the turbine; and a light sensor which is arranged in the reflection beam path of the reflector.

20. The centrifugal pump according to claim 17, wherein:

the turbine wheel is mounted in the centrifugal pump in a rotationally fixed manner;

the means for sensing the response of the turbine wheel to the torque exerted by the delivery flow comprises:

a moment arm engaging the turbine wheel; and a force sensor in contact with the moment arm which measures a torque that is responsive to the torque exerted by the delivery flow and acting upon the turbine wheel.

* * * * *